US005555837A

United States Patent [19]

Marshall et al.

[11] Patent Number: 5,555,837

[45] Date of Patent: Sep. 17, 1996

[54] BOAT STABILIZING RUDDER SYSTEM

[76] Inventors: Floyd Marshall, 1530 Fogg Pike, Mt. Sterling, Ky. 40353-9584; Terry Marshall, Rte. 4, Box 311 B, Winamac, Ind. 46996

[21] Appl. No.: 493,641

[22] Filed: Jun. 22, 1995

[51] Int. Cl.[6] ..... B63H 25/10; B63H 25/38

[52] U.S. Cl. ..... 114/153; 114/162; 114/165; 114/144 E

[58] Field of Search ..... 440/6, 7, 63; 114/144 R, 114/153, 162, 165, 144 A, 144 E

[56] References Cited

U.S. PATENT DOCUMENTS

| | | | |
|---|---|---|---|
| 2,993,464 | 7/1961 | Conover | 114/162 |
| 3,598,947 | 8/1971 | Osborn | 440/7 |
| 3,674,228 | 7/1972 | Horton | 440/63 |
| 4,211,180 | 7/1980 | Brooks, Jr. | 114/162 |
| 4,614,900 | 9/1986 | Young | 114/144 R |

*Primary Examiner*—Sherman Basinger

[57] ABSTRACT

A boat stabilizing rudder system is disclosed. A rudder is formed of planar sheet material positionable in a vertical orientation. A vertically positioned support rod has a lower end, an upper end and an elongated central extent therebetween. The lower end is formed with plates adapted to be coupled to the rudder. The upper end is mounted on a driven gear adapted for rotation about a vertical axis. A bracket has an aperture adapted to receive the intermediate upper extent of the rod beneath the gear for rotation of the rod with the rudder therebeneath about a vertical axis. Also included is a drive box with a motor, a driven shaft, and a drive gear in driving contact with the driven gear. The bracket also has an aperture therethrough with a first pivot pin constituting a hinge. A pivot box has horizontally disposed second apertures therethrough with a second pivot pin positioned through the second apertures. A positioning rod has an exterior end with an outboard aperture receiving the first pivot pin. It also has an intermediate extent and an inboard aperture for receiving the second pivot pin. The positioning rod is movable from a forward orientation wherein its exterior end is located over the water remote from the boat and in an inoperative position over the boat remote from the water for positioning the rudder in a stowed orientation.

6 Claims, 3 Drawing Sheets

BOAT STABILIZING RUDDER SYSTEM

BACKGROUND OF THE INVENTION

1. Field of the Invention

The present invention relates to a boat stabilizing rudder system and, more particularly, pertains to maintaining a boat on a predetermined course and for changing the rudder and predetermined course by operator controls.

2. Description of the Prior Art

The use of rudders and other boat controlling devices of various designs and configurations is known in the prior art. More specifically, rudders and other boat controlling devices of various designs and configurations heretofore devised and utilized for the purpose of controlling the motion of boats through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,522,142 to Frye, Jr. a rudder-tiller control system for a boat.

U.S. Pat. No. 4,634,388 to Covell discloses a rudder for electric trolling motor.

U.S. Pat. No. 4,807,553 to Brown discloses a retractable rudder for lightweight trolling motor propelled fishing boat.

U.S. Pat. No. 4,944,702 to Cain discloses a housing rudder for an electric trolling motor.

U.S. Pat. No. 5,172,648 to Isham discloses a steering mechanism for a boat.

Lastly, U.S. Pat. No. Design 313,003 to Cain discloses an encasing rudder for an electric trolling motor.

In this respect, the boat stabilizing rudder system according to the present invention substantially departs from the conventional concepts and designs of the prior art, and in so doing provides an apparatus primarily developed for the purpose of maintaining a boat on a predetermined course and for changing the rudder and predetermined course by operator controls.

Therefore, it can be appreciated that there exists a continuing need for a new and improved boat stabilizing rudder system which can be used for stabilizing the position of a boat through a fixed rudder with operator controls. In this regard, the present invention substantially fulfills this need.

SUMMARY OF THE INVENTION

In view of the foregoing disadvantages inherent in the known types of rudders and other boat controlling devices of various designs and configurations now present in the prior art, the present invention provides an improved boat stabilizing rudder system. As such, the general purpose of the present invention, which will be described subsequently in greater detail, is to provide a new and improved boat stabilizing rudder system and method which has all the advantages of the prior art and none of the disadvantages.

To attain this, the present invention essentially comprises a new and improved boat stabilizing rudder system comprising, in combination, a rudder formed of planar sheet material positionable in a vertical orientation and coupled with respect to a boat with which it is to be utilized for stabilizing the course of the boat, the rudder having vertically aligned apertures therethrough; a vertically positioned support rod having a lower end, an upper end and an elongated central extent therebetween, the lower end being formed with plates having apertures therethrough adapted to be aligned with the apertures of the rudder, the upper end having mounted thereon a driven gear adapted for rotation about a vertical axis and the central extent adapted to position the upper end at a location above a waterline with the lower end beneath the waterline; a bracket having an aperture extending therethrough in a vertical orientation, the aperture adapted to receive the intermediate upper extent of the rod beneath the gear for rotation of the rod with the rudder therebeneath about a vertical axis, and also including a drive box with a motor and a driven shaft and a drive gear in driving contact with the driven gear and lines extending therefrom into the boat to which the rudder assembly is to be coupled, the bracket also having a horizontally disposed aperture therethrough with a first pivot pin constituting a hinge; a pivot box mounted to the boat with which the rudder is to be utilized, the pivot box having horizontally disposed second apertures therethrough with a second pivot pin positioned through the second apertures; a positioning rod having an exterior end with an outboard aperture receiving the first pivot pin and having an intermediate extent and an inboard aperture for receiving the second pivot pin, the positioning rod movable from a forward orientation wherein its exterior end is located over the water remote from the boat and in an inoperative position over the boat remote from the water for positioning the rudder in a stowed orientation; control means with lines coupled to the lines of the motor for the actuation thereof, the control means including a foot-operated pedal to drive the motor in one direction or the other for rotating the rudder to an intended orientation, the control means also including a hand-operated control adapted for use as an alternative to the foot pedal; a battery positionable within the boat with a line coupled to the motor for the energization thereof; and a pull cord adapted for manipulation by a user to effect the movement of the positioning rod between the operative and inoperative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and boat stabilizing rudders for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat stabilizing rudder system which has all the advantages of the prior art rudders and other boat controlling devices of various designs and configurations and none of the disadvantages.

It is another object of the present invention to provide a new and improved boat stabilizing rudder system which may be easily and efficiently manufactured and marketed.

It is a further object of the present invention to provide a new and improved boat stabilizing rudder system which is of a durable and reliable construction.

An even further object of the present invention is to provide a new and improved boat stabilizing rudder system which is susceptible of a low cost of manufacture with regard to both materials and labor, and which accordingly is then susceptible of low prices of sale to the consuming public, thereby making such rudders and other boat controlling devices of various designs and configurations economically available to the buying public.

Still yet another object of the present invention is to provide a new and improved boat stabilizing rudder system which provides in the apparatuses and methods of the prior art some of the advantages thereof, while simultaneously overcoming some of the disadvantages normally associated therewith.

Even still another object of the present invention is to maintain a boat on a predetermined course and for changing the rudder and predetermined course by operator controls.

Lastly, it is an object of the present invention to provide a boat stabilizing rudder system. A rudder is formed of planar sheet material positionable in a vertical orientation and coupled with respect to a boat with which it is to be utilized for stabilizing the course of the boat. The rudder has vertically aligned apertures therethrough. A vertically positioned support rod has a lower end, an upper end and an elongated central extent therebetween. The lower end is formed with plates having apertures therethrough adapted to be aligned with the apertures of the rudder. The upper end is mounted on a driven gear adapted for rotation about a vertical axis. The central extent is adapted to position the upper end at a location above a waterline with the lower end beneath the waterline. A bracket has an aperture extending therethrough in a horizontal orientation. The aperture is adapted to receive the intermediate upper extent of the rod beneath the gear for rotation of the rod with the rudder therebeneath about a vertical axis. Also included is a drive box with a motor and a driven shaft and a drive gear in driving contact with the driven gear and lines extending therefrom into the boat to which the rudder assembly is to be coupled. The bracket also has a horizontally disposed aperture therethrough with a first pivot pin constituting a hinge. A pivot box is mounted to the boat with which the rudder is to be utilized. The pivot box has horizontally disposed second apertures therethrough with a second pivot pin positioned through the second apertures. A positioning rod has an exterior end with an outboard aperture receiving the first pivot pin. It also has an intermediate extent and an inboard aperture for receiving the second pivot pin. The positioning rod is movable from a forward orientation wherein its exterior end is located over the water remote from the boat and in an inoperative position over the boat remote from the water for positioning the rudder in a stowed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
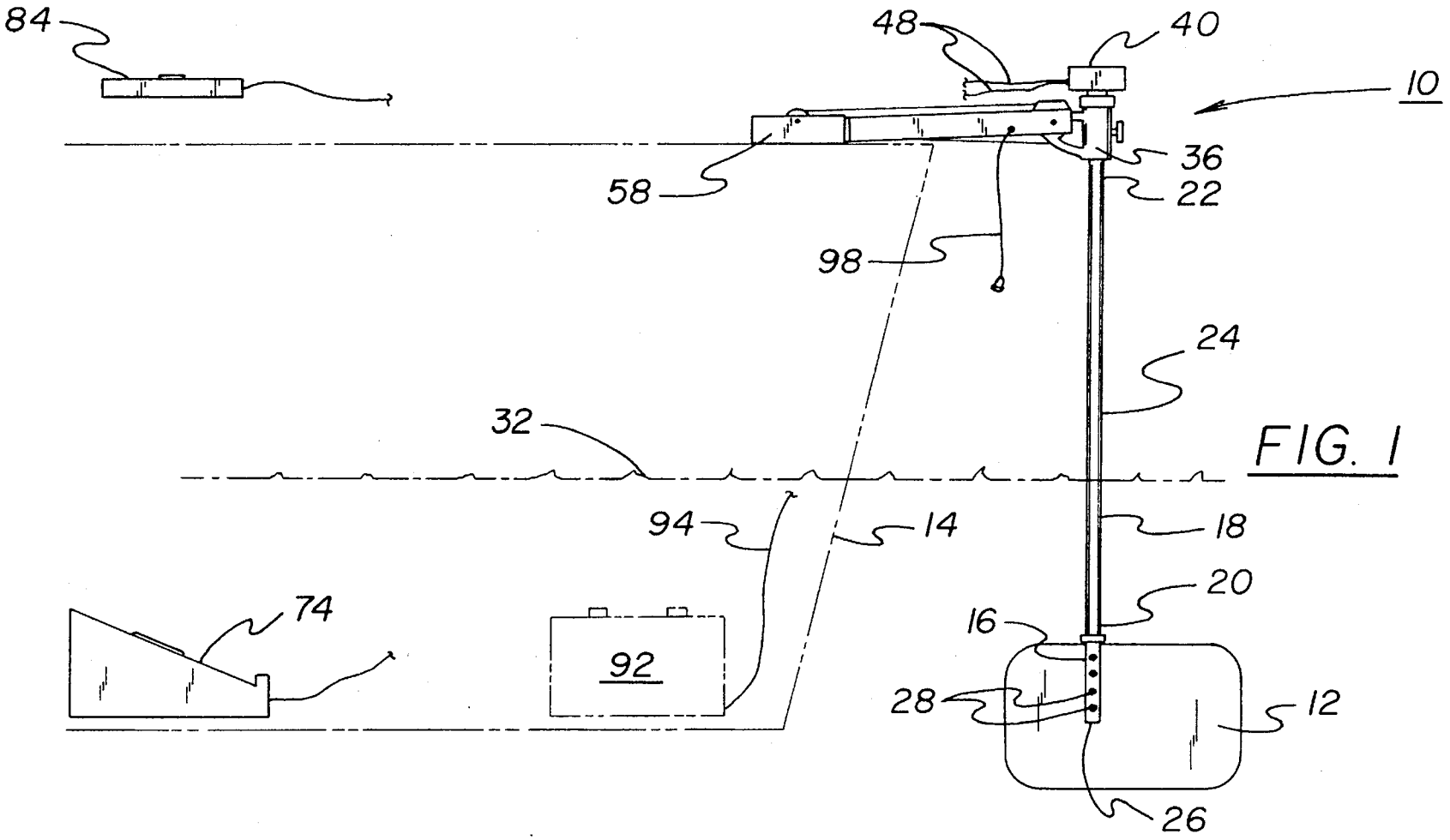
FIG. 1 is a side elevational view of the primary embodiment of the new and improved boat stabilizing rudder system constructed in accordance with the principles of the present invention with a portion of the boat shown in phantom line.
Figure 2:
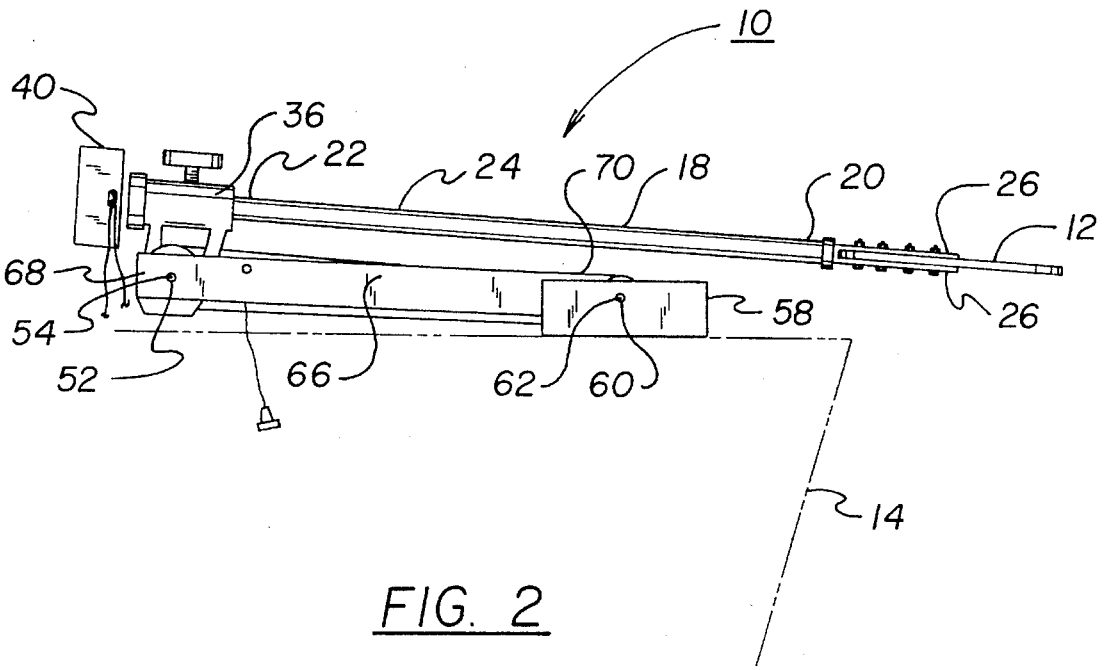
FIG. 2 is an enlarged side elevational view of the apparatus shown in FIG. 1 but illustrating such apparatus in the withdrawn orientation.
Figure 3:
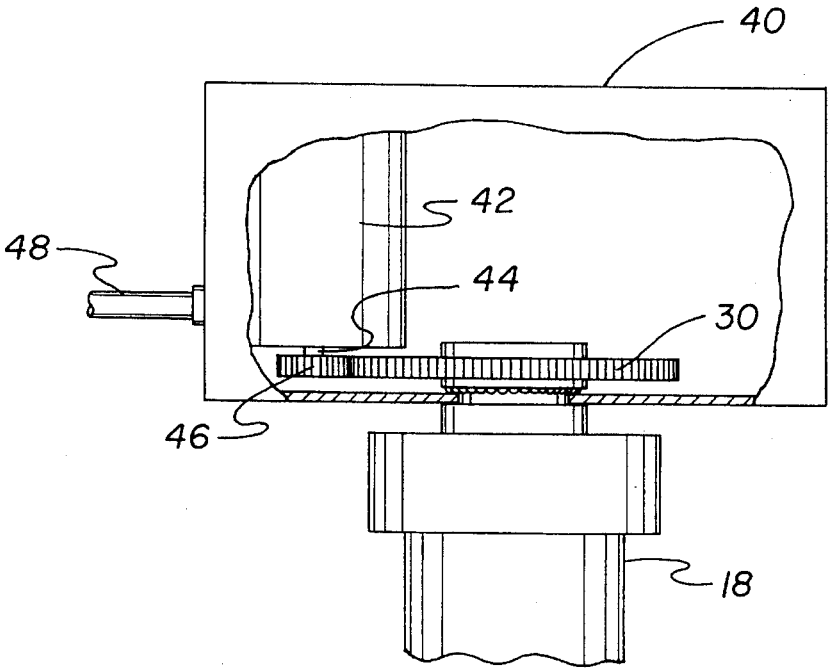
FIG. 3 is an enlarged side elevational view of the upper end of the control drive mechanisms of the device shown in FIGS. 1 and 2 but with parts broken away to show certain internal constructions thereof.
Figure 4:
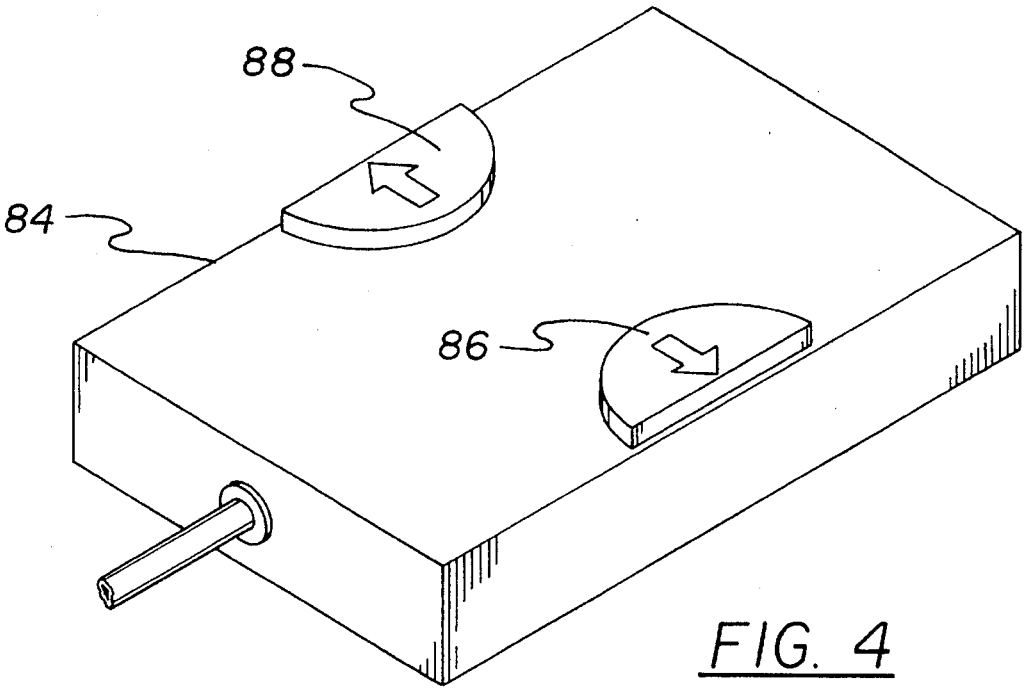
FIG. 4 is a perspective illustration of the hand control for the device of the prior Figures as illustrated in FIG. 1.
Figure 5:
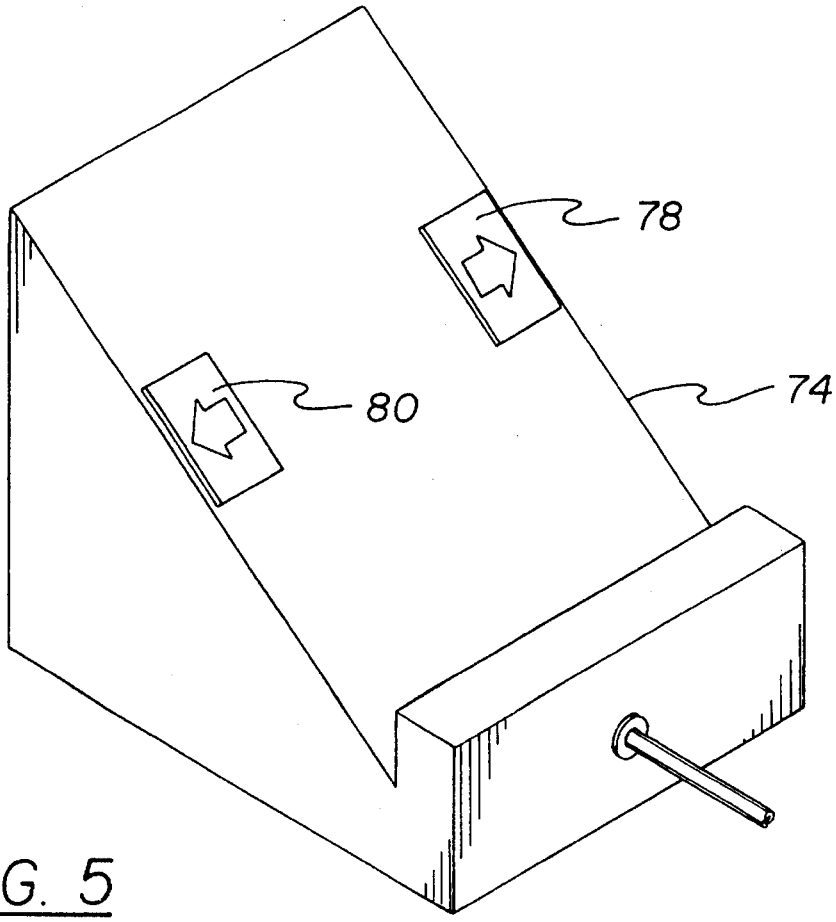
FIG. 5 is a perspective view of the foot control for the device of the prior Figures as illustrated in FIG. 1.

With reference now to the drawings, and in particular to FIG. 1 thereof, the preferred embodiment of the new and improved boat stabilizing rudder system embodying the principles and concepts of the present invention and generally designated by the reference numeral 10 will be described.

The present invention is a new and improved boat stabilizing rudder system 10 comprised of a plurality of components. In their broadest context, the components include a rudder, a support rod, bracket, pivot box, positioning rod, control mechanisms, battery and pull cord. Each of the individual components is specifically configured and correlated one with respect to the other so as to attain the desired objectives.

The boat stabilizing rudder system 10 of the present invention has as its primary component a rudder 12. Such rudder is formed of a planar sheet material. It is positionable in a vertical orientation. It is coupled with respect to the boat 14 with which it is to be utilized. Its function is for stabilizing the course of the boat. Coupling is effected through vertically aligned apertures 16 extending through the rudder.

Operable in association with the rudder is a vertically positioned support rod 18. Such support rod has a lower end 20, an upper end 22 and an elongated central extent 24 therebetween. The lower end of the support rod is formed with plates 26 having apertures therethrough. Such apertures have horizontal axes and are adapted to be aligned with the apertures 16 of the rudder. This is to effect the coupling therebetween. The upper end of the support rod has mounted thereon a driven gear 30. Such driven gear is adapted for rotation about a vertical axis during operation and use. The central extent of the rod is adapted to position the upper end of the rod at a location above the water line 32 with the lower end beneath the water line.

Located at the upper end of the support rod is a bracket 36. Such bracket has an aperture 38 extending therethrough in a vertical orientation during operation and use. Such aperture is adapted to receive the upper extent of the rod beneath the gear. The rod and gear are adapted to rotate within the aperture of the bracket for rotating the rod and rudder therebeneath about a vertical axis during operation and use.

Also operable in association with the bracket is a drive box 40. The drive box has a motor 42 and a driven shaft 44 as well as a drive gear 46 mounted on the driven shaft. The drive gear 46 is in meshing, driving contact with the driven gear 30. In addition, lines extend from the drive box coupled at their upper extent to the motor and extend downwardly therefrom into the boat to which the rudder 12 is to be coupled. The bracket also has a horizontally disposed aperture 52 therethrough. In association therewith a first pivot pin 54 extends through the apertures to constitute a hinge.

Mounted to the boat with which the boat stabilizing rudder 12 is to be utilized is a pivot box 58. Such pivot box has a horizontally disposed second aperture 60 extending therethrough. A second pivot pin 62 is positioned through the second apertures.

A positioning rod 66 is next provided. Such positioning rod has an exterior end 68 with an outboard aperture therethrough. Such aperture is for receiving the first pivot pin. The positioning rod also has an intermediate extent 70 and an inboard aperture. Such inboard aperture is for receiving the second pivot pin. The positioning rod 66 is movable between a forward orientation wherein its exterior end is located over the water remote from the boat. It is also movable to an inoperative position over the boat and remote from the water. This positioning of the rudder is for a stowed orientation when not operating or during storage or transportation or the like.

In association with the motor are control means. The control means include lines coupled to the lines of the motor for the actuation and inactuation thereof so as to rotate the support rod and change the position of the rudder. The control means include a foot-operated pedal 74 to drive the motor in one direction or the other for rotating the rudder to an intended orientation. The control means also include a hand-operated control 84 adapted for use as an alternative to the foot pedal. One of such controls or the other may be utilized as well as a combination of the two controls.

Also in association with the control mechanisms is a battery 92. Such battery is positionable within the boat. It includes a supplemental electrical line 94 coupled to the motor. Such is for the powering of the motor during operation and use.

Lastly provided is a pull cord 98. Such pull cord has a free end adapted to be held by a user and a remote end coupled to the positioning rod. The function of the cord is for movement of the positioning rod between the operative and inoperative positions as described above.

The present invention is a fixed rudder which keeps a boat on a straight course when casting banks, weed beds and structures. The stabilizing rudder is extremely effective in keeping a boat parallel to shore for optimum casting position by a fisherman.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved boat stabilizing rudder system comprising, in combination:

a rudder formed of planar sheet material positionable in a vertical orientation and coupled with respect to a boat with which it is to be utilized for stabilizing the course of the boat, the rudder having vertically aligned apertures therethrough;

a vertically positioned support rod having a lower end, an upper end and an elongated central extent therebetween, the lower end being formed with plates having apertures therethrough adapted to be aligned with the apertures of the rudder, the upper end having mounted thereon a driven gear adapted for rotation about a vertical axis and the central extent adapted to position the upper end at a location above a waterline with the lower end beneath the waterline;

a bracket having an aperture extending therethrough in a vertical orientation, the aperture adapted to receive the upper end of the rod beneath the gear for rotation of the rod with the rudder therebeneath about a vertical axis, and also including a drive box with a motor and a driven shaft and a drive gear in driving contact with the driven gear and lines extending from the motor into the boat to which the rudder system is to be coupled, the bracket also having a horizontally disposed aperture therethrough with a first pivot pin constituting a hinge;

a pivot box mounted to the boat with which the rudder is to be utilized, the pivot box having horizontally disposed second apertures therethrough with a second pivot pin positioned through the second apertures;

a positioning rod having an exterior end with an outboard aperture receiving the first pivot pin and having an intermediate extent and an inboard aperture for receiving the second pivot pin, the positioning rod movable from a forward orientation wherein its exterior end is located over the water remote from the boat and in an inoperative position over the boat remote from the water for positioning the rudder in a stowed orientation;

control means with lines coupled to the lines of the motor for the actuation thereof, the control means including a foot-operated pedal to drive the motor in one direction or the other for rotating the rudder to an intended orientation, the control means also including a hand-operated control adapted for use as an alternative to the foot pedal;

a battery positionable within the boat with a line coupled to the motor for the energization thereof; and a pull cord adapted for manipulation by a user to effect the movement of the positioning rod between the forward and inoperative orientation.

2. A boat stabilizing rudder system comprising:

a rudder formed of planar sheet material positionable in a vertical orientation and coupled with respect to a boat with which it is to be utilized for stabilizing the course of the boat, the rudder having vertically aligned apertures therethrough;

a vertically positioned support rod having a lower end, an upper end and an elongated central extent therebetween, the lower end being formed with plates having apertures therethrough adapted to be aligned with the apertures of the rudder, the upper end having mounted thereon a driven gear adapted for rotation about a vertical axis and the central extent adapted to position the upper end at a location above a waterline with the lower end beneath the waterline;

a bracket having an aperture extending therethrough in a vertical orientation, the aperture adapted to receive the upper end of the rod beneath the gear for rotation of the rod with the rudder therebeneath about a vertical axis, and also including a drive box with a motor and a driven shaft and a drive gear in driving contact with the driven gear and lines extending from the motor into the boat to which the rudder system is to be coupled, the bracket also having a horizontally disposed aperture therethrough with a first pivot pin constituting a hinge;

a pivot box mounted to the boat with which the rudder is to be utilized, the pivot box having horizontally disposed second apertures therethrough with a second pivot pin positioned through the second apertures; and a positioning rod having an exterior end with an outboard aperture receiving the first pivot pin and having an intermediate extent and an inboard aperture for receiving the second pivot pin, the positioning rod movable from a forward orientation wherein its exterior end is located over the water remote from the boat and in an inoperative position over the boat remote from the water for positioning the rudder in a stowed orientation.

3. The apparatus as set forth in claim 2 and further including:

control means with lines coupled to the lines of the motor for the actuation thereof, the control means including a foot-operated pedal to drive the motor in one direction or the other for rotating the rudder to an intended orientation.

4. The apparatus as set forth in claim 2 and further including:

control means with lines coupled to the lines of the motor for the actuation thereof, the control means including a hand-operated control adapted for use as an alternative to a foot pedal.

5. The apparatus as set forth in claim 2 and further including:

a battery positionable within the boat with a line coupled to the motor for the energization thereof.

6. The apparatus as set forth in claim 2 and further including:

a pull cord adapted for manipulation by a user to effect the movement of the rod between the forward and inoperative orientation.

* * * * *